United States Patent [19]

Watson

[11] 4,226,352

[45] Oct. 7, 1980

[54] CONTINUOUS-ROD MAKING MACHINES

[75] Inventor: John T. Watson, High Wycombe, England

[73] Assignee: Molins Limited, England

[21] Appl. No.: 2,091

[22] Filed: Jan. 9, 1979

[30] Foreign Application Priority Data

Jan. 13, 1978 [GB] United Kingdom ..... 135478/78

[51] Int. Cl.[3] ..... B26F 3/00

[52] U.S. Cl. ..... 225/100; 225/98; 225/101; 225/106

[58] Field of Search ..... 225/101, 100, 106, 98, 225/4

[56] References Cited

U.S. PATENT DOCUMENTS

| | | | |
|---|---|---|---|
| 2,510,788 | 6/1950 | Willett | 225/101 |
| 2,523,183 | 9/1950 | Beall | 225/100 X |
| 3,133,684 | 5/1964 | Wiltshire et al. | 225/101 |
| 3,954,051 | 5/1976 | Steiniger | 93/77 FT |

FOREIGN PATENT DOCUMENTS

| | | | |
|---|---|---|---|
| 1179728 | 12/1958 | France | 225/101 |
| 861320 | 2/1961 | United Kingdom | 225/101 |

*Primary Examiner*—Frank T. Yost
*Attorney, Agent, or Firm*—Craig & Antonelli

[57] ABSTRACT

An improvement in continuous-rod making machines comprises a rod-breaking mechanism, particularly for a composite filter rod, which has spaced grippers for gripping the rod and accelerating it in a generally lengthwise direction. In a preferred construction a pivoted segment carries the grippers and cam means is provided for moving the grippers together as the segment is itself moved. The segment may carry a deflector for directing the rod to waste and means may be provided for releasing the leading part of the rod after it has been broken. The new leading end of the rod on a conveyor band passes to a rod-receiving member, which may be the entry to a rod cut-off mechanism or rod-measuring device.

12 Claims, 4 Drawing Figures

CONTINUOUS-ROD MAKING MACHINES

This invention concerns improvements in continuous-rod making machines and, more particularly, in rod-breaking mechanisms for machines for making cigarette or cigarette filter rod.

In continuous-rod making machines in the cigarette industry a moving rod is formed by wrapping a moving paper web around a filler in a rod-forming mechanism, the rod then passing to a cut-off mechanism where it is severed into rod lengths. Normally the rod-forming mechanism includes means for applying adhesive to an edge of the paper web before it is wrapped around the filler and a heater to seal the overlapped edges of the web after wrapping. The filler could comprise a stream of tobacco or filter material, of a stream or preformed filter portions for forming into a composite filter rod.

When the machine is started, the rod issuing from the rod-forming mechanism is usually unsatisfactory at first. For example, it may not be correctly sealed or filled. It is therefore normal practice to prevent this initial rod portion from entering the cut-off until a satisfactory rod is being produced, and until then the rod is deflected to a waste receptacle. When the rod produced becomes satisfactory, it is broken to provide a new leading end to feed along the normal rod path to the cut-off mechanism.

One form of rod-breaking mechanism, including means for cutting the rod to produce a new leading end, is disclosed in British Pat. No. 1,021,741. A simpler form of mechanism, in which the rod is broken by excessive deflection, is disclosed in British Pat. No. 1,042,148. The type of mechanism employed will often depend on the type of rod being produced. For example, while the cigarette rod can be broken successfully by deflection, some types of cigarette filter rod (e.g. those containing cellulose acetate fibers) are more difficult to break and may require cutting. It is an object of the present invention to provide a rod-breaking mechanism which is particularly, but not exclusively, suitable for use with composite filter rod.

According to the invention a rod-breaking mechanism for a continuous rod making machine comprises spaced gripping means on opposite sides of a rod path, first moving means for moving said spaced gripping means together and into engagement with the rod to grip said rod, and second moving means for moving said gripping means in a direction generally lengthwise of the rod such that the leading part of the rod is separated from the remainder of the rod. Preferably the second moving means is arranged to accelerate the leading part of the rod. The rod path need not be the path followed by the rod when the machine is in normal operation; the rod is preferably deflected during initial running of the machine (prior to use of the rod-breaking mechanism) and the gripping means may be adjacent the deflected path. Where the rod is moved on a deflected path, the gripping means is preferably moved generally along this path after it has gripped the rod. Breakage of the rod may then be caused principally by the combined effect of gripping and accelerating the leading part of the rod. The rod could in fact be broken solely by this action, without any sideways deflection. The gripping means may, however, be moved along a path which deflects the rod by an amount sufficient to break it. Engagement of the gripping means may extend along the rod and restrict its lateral flexibility to such an extent that less deflection is required to break the rod than would be necessary if the rod were not so restricted. The gripping means may have a concave section adapted to conform to the periphery of the rod. The gripping means is preferably arranged to release the rod after it has been broken so that the broken part can fall into a waste receptacle.

In a preferred construction the spaced gripping means includes two members adapted to grip the opposite sides of the rod, one member being fixed to a segment pivoted about an axis transverse to the rod path and the other member being carried at one end of an arm pivoted to the segment about a parallel axis. The other end of the arm carries a roller adapted to follow a fixed cam track when the segment is moved, to cause the movable member to move towards the fixed member and thereby grip and clamp the rod. The segment may be moved by spring means and may be held in its primed position by a releasable latch. The segment may also carry deflector means for guiding the rod on its deflected path.

The invention will now be further described, by way of example only, with reference to the accompanying diagrammatic drawings, in which.

Figure 1:
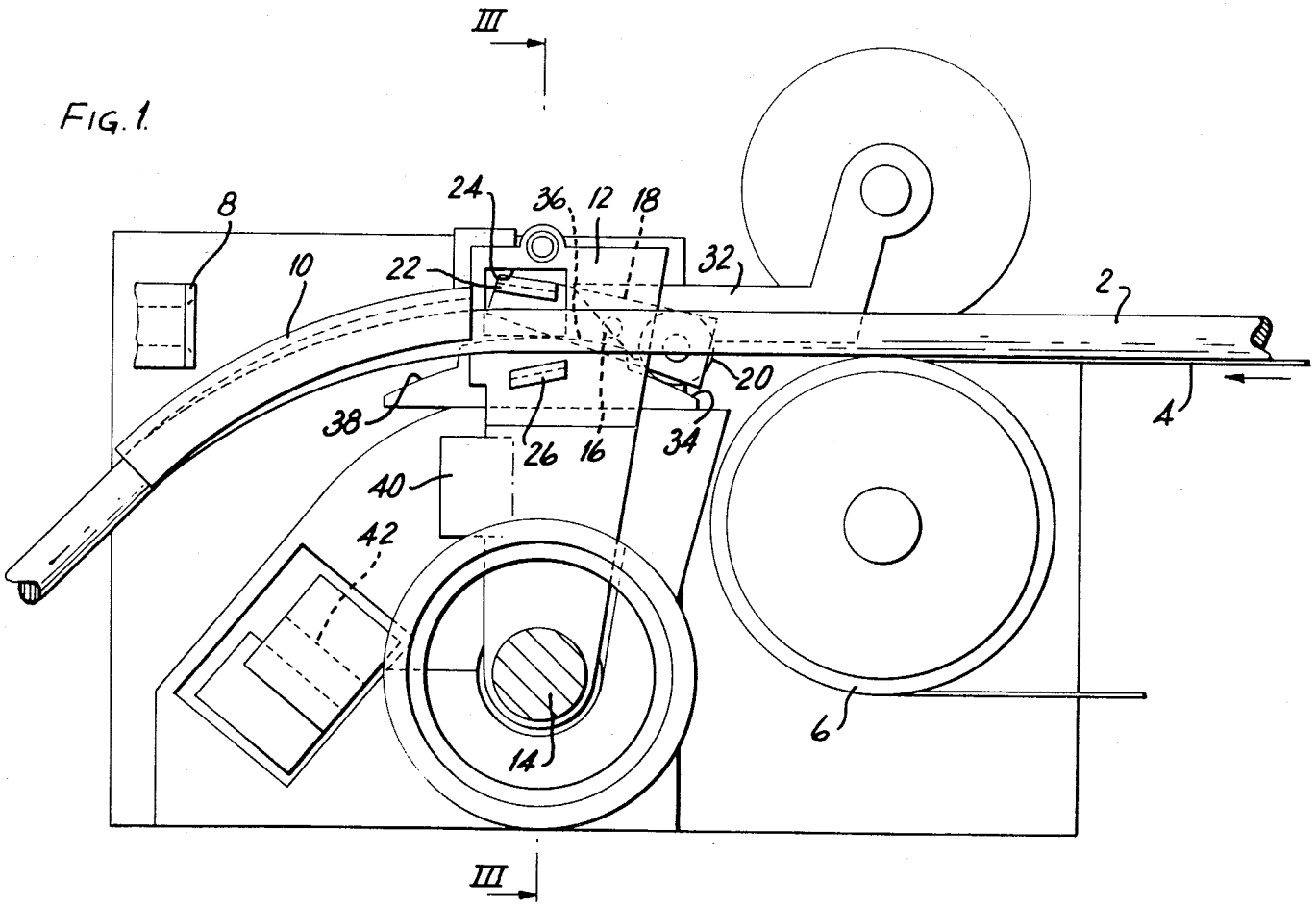
FIG. 1 is a side view of a rod-breaking mechanism.
Figure 2:
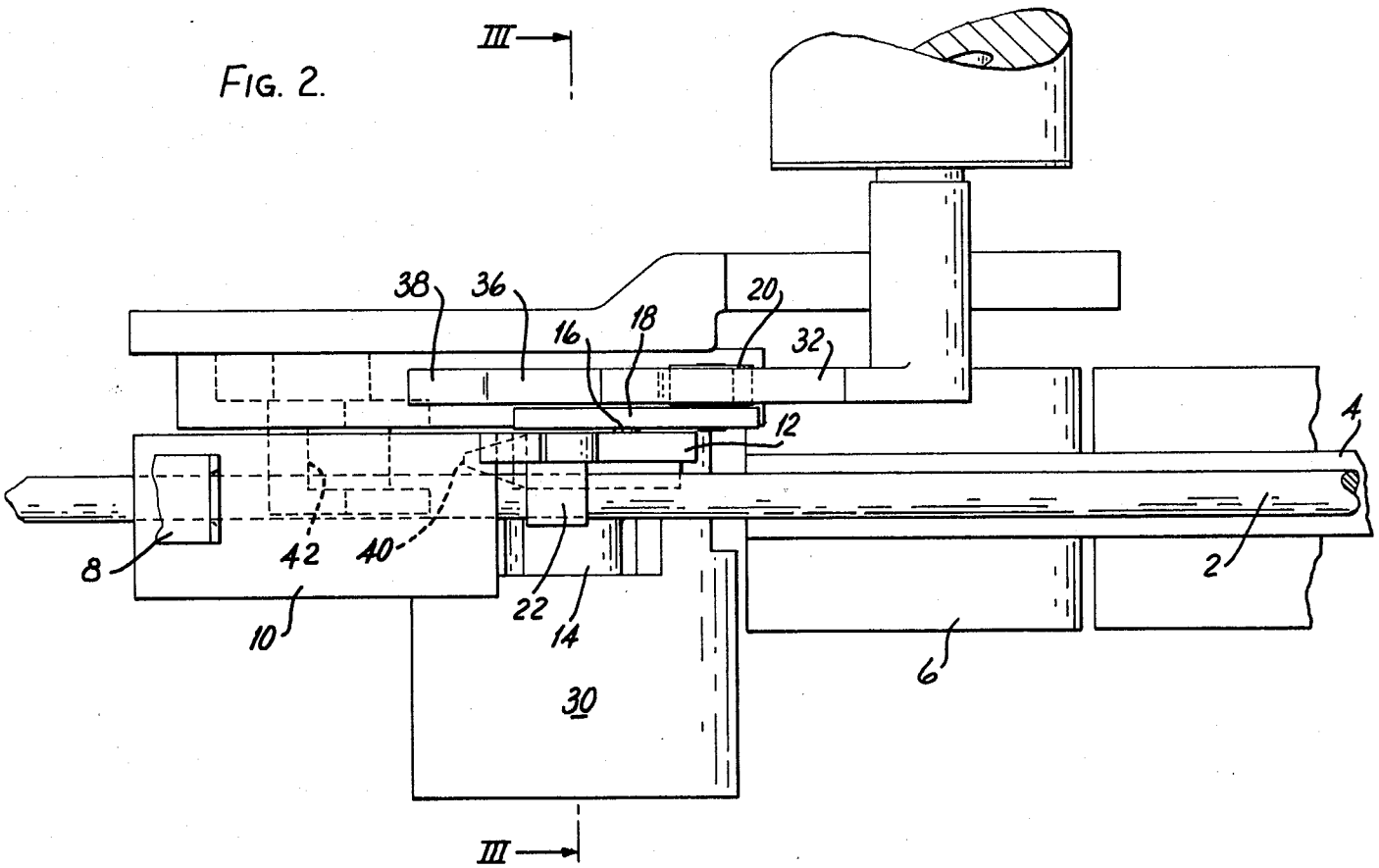
FIG. 2 is a plan view of the mechanism of FIG. 1.
Figure 3:
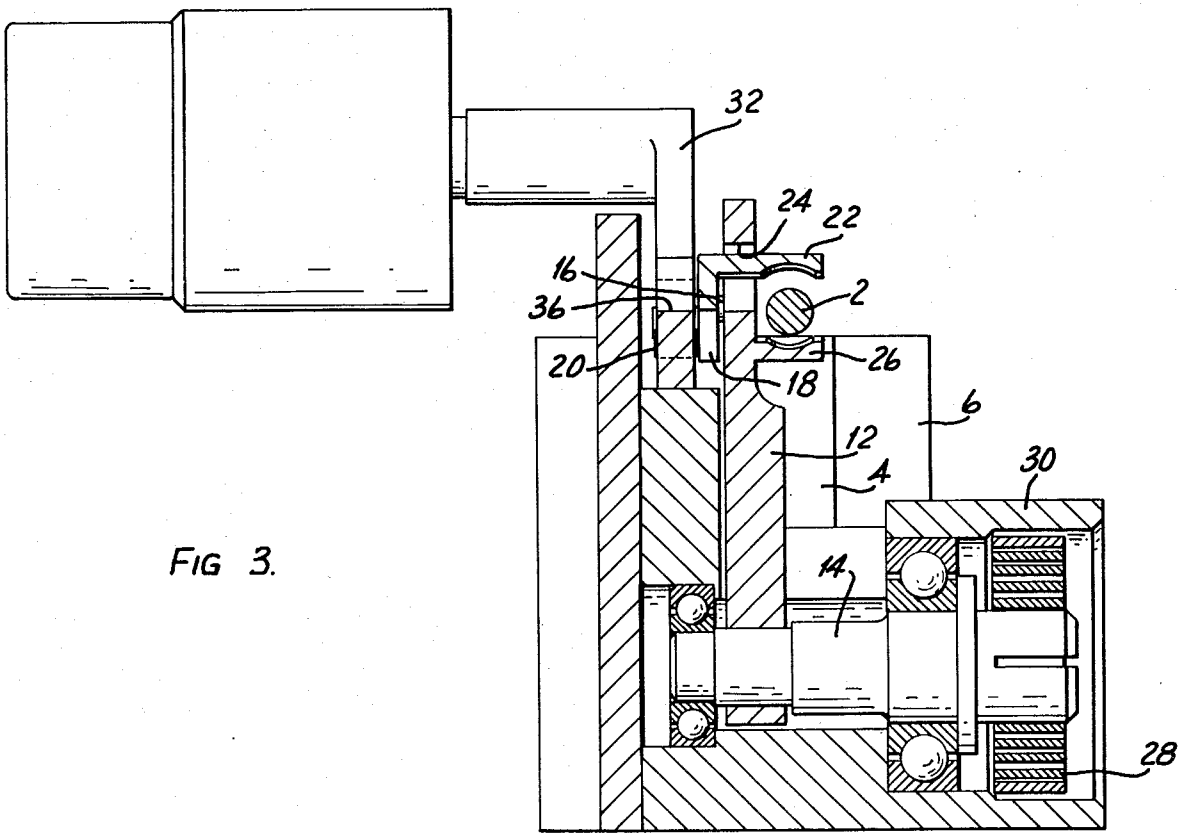
FIG. 3 is a sectional view on the line III—III in FIGS. 1 and 2.

Referring to FIGS. 1 to 3, a continuous rod 2 is carried from a rod-forming mechanism (not shown) by a conveyor band 4, which passes around wheel 6. The rod-forming and rod-breaking mechanisms may be parts of a machine for producing composite filter rod (e.g. Molins DAPTCM or DR2N) and in normal operation of the machine the rod 2 continues in a substantially straight path (possibly between fixed guide elements, not shown) from the wheel 6 to a rod-receiving member 8, which may form the entry to a rod cut-off mechanism or a rod measuring device.

In the position shown in FIG. 1, which typically represents the situation just after the machine has been started, the rod 2 is guided by a curved deflector plate 10 downwards towards a waste receptacle (not shown). The plate 10 is attached to a segment 12 which lies in a substantially vertical plane alongside the path of the rod 2 and which is keyed to a shaft 14. On its side remote from the rod path the segment 12 has a pivot 16 which carries an arm 18. A roller 20 is mounted on one end of the arm 18. The other end of the arm 18 carries a gripping or clamping plate 22 which extends from the arm through a window 24 in the segment 12 to a position above the rod path. A further clamping plate 26 fixed to the segment 12 extends below the rod path. Both plates 22 and 26 have concave facing surfaces and may be provided with serrations or other gripping means along their lengths.

The shaft 14 is strongly biased by means of a clock spring 28 contained in a housing 30, and the shaft and segment 12 are prevented from counter-clockwise rotation (as viewed in FIG. 1) by a releasable latch 32, which is shaped to fit over and engage the roller 20 and thereby restrain movement of the segment. While it is held by the latch 32 the roller 20 is also in contact with the first part 34 of a fixed cam surface.

Figure 4:
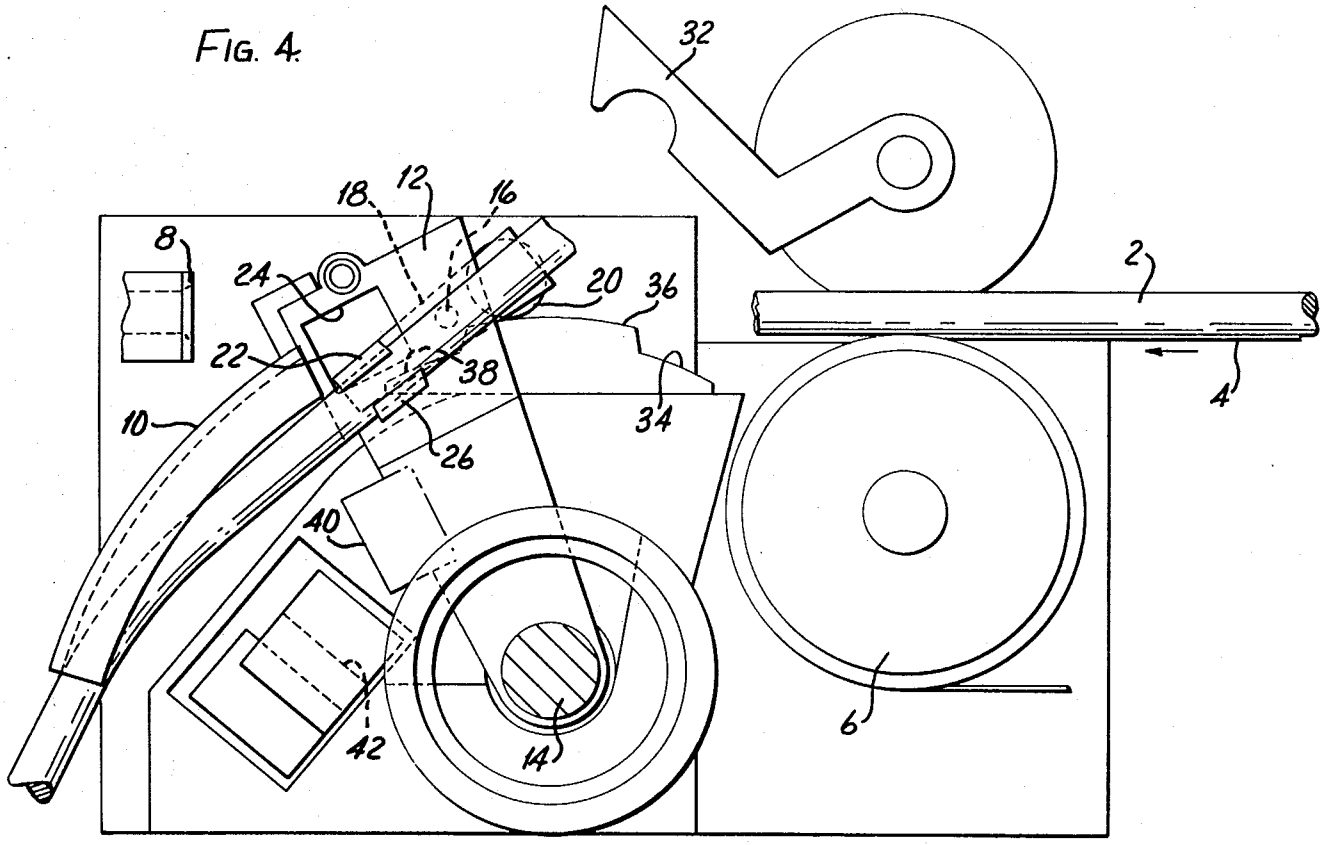
FIG. 4 is a view corresponding to FIG. 1 with parts of the mechanism in different operating positions.

When the latch 32 is released (by rotation in a clockwise direction as viewed in FIG. 1, and by solenoid means for example) the segment 12 starts to move, at first in a direction generally parallel to the rod path, under action of the spring 28. As the segment 12 moves, the roller 20 is moved along the first part 34 of the cam surface and onto a second, higher part 36 of the surface separated from the first part by a step. Movement of the roller 20 onto the higher part 36 of the cam surface causes counter-clockwise movement of the arm about its pivot 16, so that the clamping plate 22 is moved closer to the plate 26. This movement of the roller 20 onto and along the part 36, and the movement of the segment 12 caused by the spring 28, causes the rod 2 to be clamped between the plates 22 and 26 and to be accelerated and/or deflected sufficiently to break it, as indicated in FIG. 4. Where the rod comprises composite filter rod the break will normally occur between filter portions.

Further movement of the segment 12 under action of the spring 28 eventually causes roller 20 to come off the second, higher part 36 of the cam surface onto a third, lower part 38, so that the grip on the broken end of the rod between plates 22 and 26 is relaxed allowing it to be released to fall into the waste receptacle. The limit of the movement of the segment 12 is determined by engagement of a resilient abutment 40 carried by the segment with a fixed stop 42.

When the segment 12 is on its stop 42 the deflector plate 10 and clamping plates 22 and 26 are clear of the rod path and the leading broken end of the rod 2 issuing from the rod-forming mechanism has a clear, straight path into the receiving member 8. Fixed guides (not shown) alongside the rod path may be provided for ensuring entry of the rod 2 into the receiving member 8, but normally the inherent stiffness of the rod will cause it to follow a straight path from the wheel 6 without additional guide means. Some form of guide e.g. a funnel-shaped device, could however be provided to lead the rod into the rod-breaking mechanism: this guide could be fixed or attached to a movable part of the mechanism.

The segment 12 remains on its stop 42 during operation of the machine. When the machine is next stopped the segment 12 is moved once again to its primed position (as shown in FIG. 1) and held there by means of the latch 32 in readiness for operation of the rod-breaking mechanism after restarting of the machine.

I claim:

1. A continuous rod-making machine, comprising means for conveying a continuous rod along an axial path at substantially constant speed, spaced gripping means on opposite sides of said path, first moving means for moving said spaced gripping means together and into engagement with a rod on said path to grip said rod, the gripping means being arranged to extend along and engage the rod along part of its length, and second moving means for moving said gripping means in a direction generally lengthwise of the rod and for accelerating said gripping means from rest to a speed in excess of said constant speed such that the leading part of the rod is separated from the remainder of the rod as the respective parts are pulled apart.

2. A machine as claimed in claim 1, wherein the gripping means has a concave section adapted to conform to the periphery of a rod.

3. A machine as claimed in claim 1, wherein the first moving means includes means for releasing the broken leading part of the rod after said second moving means has moved said gripping means through a sufficient distance to separate said leading part.

4. A rod-breaking mechanism for a continuous rod-making machine, comprising spaced gripping means on opposite sides of a rod path, first moving means for moving said spaced gripping means together and into engagement with a rod on said path to grip said rod, second moving means for moving said gripping means in a direction generally lengthwise of the rod including means to accelerate the leading part of the rod such that the leading part of the rod is separated from the remainder of the rod, and means for deflecting the rod along a deflected path, said gripping means being arranged adjacent said deflected path.

5. A rod-breaking mechanism as claimed in claim 4, wherein the second moving means is arranged to move the gripping means generally along said deflected path.

6. A rod-breaking mechanism for a continuous rod-making machine, comprising spaced gripping means on opposite sides of a rod path, first moving means for moving said gripping means together and into engagement with a rod on said path to grip said rod, and second moving means for moving said gripping means in a direction generally lengthwise of the rod such that the leading part of the rod is separated from the remainder of the rod, wherein the spaced gripping means includes two members adapted to grip the opposite sides of a rod, said second moving means including a segment pivoted about an axis transverse to the rod path, one of said members being fixed to said segment, and said first moving means including an arm pivoted to the segment about a parallel axis, the other member being carried by said arm.

7. A rod-breaking mechanism as claimed in claim 6, including cam means for moving said arm about its axis as said segment moves about its axis, so that said other member is moved towards said one member to grip the rod.

8. A rod-breaking mechanism as claimed in claim 6, including spring means for moving said segment about its axis, and a releasable latch for holding said segment in a primed position.

9. A rod-breaking mechanism as claimed in claim 6, including deflector means carried by said segment for guiding a rod on a deflected path.

10. A rod-breaking mechanism for a continuous rod-making machine, comprising spaced gripping means on opposite sides of a rod path, first moving means for moving said spaced gripping means together and into engagement with a rod on said path to grip said rod, second moving means for moving said gripping means in a direction generally lengthwise of the rod such that the leading part of the rod is separated from the remainder of the rod, and means for deflecting the rod along a deflected path, said gripping means being arranged adjacent said deflected path.

11. A rod-breaking mechanism as claimed in claim 10, wherein said second moving means includes means to accelerate the leading part of the rod.

12. A rod-breaking mechanism as claimed in claim 10, wherein the gripping means is arranged to extend along and engage the rod along part of its length.

* * * * *